US010458675B2

(12) United States Patent
Siercke et al.

(10) Patent No.: US 10,458,675 B2
(45) Date of Patent: Oct. 29, 2019

(54) SOUND-DAMPING AIR CONDUCTION PART

(71) Applicant: AIRBUS OPERATIONS GMBH, Hamburg (DE)

(72) Inventors: Matthias Siercke, Hamburg (DE); Joakim Holmgren, Hamburg (DE); Markus Kerber, Hamburg (DE); Sergej Naumann, Hamburg (DE); Uwe Wurr, Hamburg (DE); Volker Robrecht, Hamburg (DE); Urs Pachale, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 139 days.

(21) Appl. No.: 15/445,345

(22) Filed: Feb. 28, 2017

(65) Prior Publication Data

US 2017/0248341 A1 Aug. 31, 2017

(30) Foreign Application Priority Data

Feb. 29, 2016 (DE) ..... 10 2016 203 211

(51) Int. Cl.
*F24F 13/24* (2006.01)
*F24F 13/02* (2006.01)
*G10K 11/16* (2006.01)

(52) U.S. Cl.
CPC ..... *F24F 13/24* (2013.01); *F24F 13/0245* (2013.01); *F24F 13/0281* (2013.01); *G10K 11/161* (2013.01); *F24F 2013/242* (2013.01)

(58) Field of Classification Search
CPC .. F24F 13/024; F24F 13/0245; F24F 13/0281; F24F 2013/242; G10K 11/161
(Continued)

(56) References Cited

U.S. PATENT DOCUMENTS 5,785,919 A * 7/1998 Wilson ..... B29D 24/005 264/401
6,231,710 B1 * 5/2001 Herup ..... B29C 47/0028 156/173

(Continued)

FOREIGN PATENT DOCUMENTS

DE 10 2011 108 957 A1 1/2013

OTHER PUBLICATIONS

Baallou, Glen , "Handbook for Sound Engineers" May 2, 2013, Taylor and Francis p. 111 (Year: 2013).*

(Continued)

*Primary Examiner* — Forrest M Phillips
(74) *Attorney, Agent, or Firm* — Jenkins, Wilson, Taylor & Hunt, P.A.

(57) ABSTRACT

An air conduction part for conducting a compressible medium, which part has a cross section through which the medium passes in a flow direction of the medium when the air conduction part is used, which flow direction approximately corresponds to a longitudinal axis of the air conduction part, the air conduction part including at least one wall arrangement that laterally defines the cross section of the air conduction part and conducts the medium. The wall arrangement are provided with at least one shell and with at least one damping device that removes sound energy from the medium, and the shell and the damping device are integrally interconnected so that, with a justifiable amount of outlay, the resulting air conduction parts effectively damp sound and the transport direction of the medium and/or the cross section of the air conduction part may change.

20 Claims, 2 Drawing Sheets

(58) Field of Classification Search
USPC ..... 181/224, 292, 290
See application file for complete search history.

(56) References Cited

U.S. PATENT DOCUMENTS

| | | | | |
|---|---|---|---|---|
| 9,567,087 | B1 * | 2/2017 | Monacchio | F24F 13/24 |
| 2013/0062143 | A1 * | 3/2013 | Ichihashi | G10K 11/172 181/292 |
| 2013/0264147 | A1 * | 10/2013 | Sugimoto | B61D 17/185 181/292 |
| 2013/0299274 | A1 * | 11/2013 | Ayle | G10K 11/172 181/292 |
| 2013/0341119 | A1 * | 12/2013 | Ichihashi | G10K 11/172 181/207 |
| 2014/0054108 | A1 * | 2/2014 | Wolf | E04B 1/90 181/292 |
| 2014/0090923 | A1 * | 4/2014 | Murray | F02K 3/06 181/222 |
| 2014/0133964 | A1 * | 5/2014 | Ayle | G10K 11/172 415/119 |
| 2014/0161601 | A1 | 6/2014 | Geiger | |

OTHER PUBLICATIONS

German Search Report for Application No. 10 2016 203 211 dated Oct. 25, 2016.

* cited by examiner

SOUND-DAMPING AIR CONDUCTION PART

CROSS-REFERENCE TO RELATED APPLICATION

This application claims priority to German Application No. DE 10 2016 203 211.9 filed Feb. 29, 2016, the entire disclosure of which is incorporated by reference herein.

TECHNICAL FIELD

The disclosure herein relates to an air conduction part for conducting a compressible medium, which part has a cross section through which the medium passes in a flow direction of the medium when the air conduction part is used, which flow direction approximately corresponds to a longitudinal axis of the air conduction part, the air conduction part comprising at least one wall arrangement that laterally defines the cross section of the air conduction part and conducts the medium. Furthermore, the disclosure herein also relates to a method for producing an air conduction part of this kind.

BACKGROUND

Sound-damping is necessary or desirable in many applications in aeronautical engineering, since transporting air as a compressible medium is associated with noise phenomena, either on account of sound being transported from external noise sources, or on account of sound resulting from the medium being transported on components of the air conduction parts in question.

In this case, currently only straight air conduction parts that have a uniform diameter and/or cross section, for example as pipe portions, are provided with sound-damping. For this purpose, in a complex operation and with a certain amount of outlay, sound absorption elements are introduced into shells as a damping device or dampener and are arranged together with the shells to form the relevant air conduction part.

SUMMARY

One of the ideas of the present disclosure is that of providing, with a justifiable amount of outlay, air conduction parts that have effective sound-damping and in which the transport direction of the medium and/or the cross section of the air conduction part can change.

An air conduction part of the type mentioned at the outset, in which the wall arrangement is provided with at least one shell and with at least one damping device or dampener that removes sound energy from the medium, and in that the shell and the damping device or dampener are integrally interconnected. The idea involves integrating the damping device or dampener on the shell which, as part of the wall arrangement, laterally defines the air conduction part, such that the wall arrangement changes the direction or cross section of the air conduction part while the medium is being transported. In this way, for example air conduction parts that form bent pipe pieces ("bends") or distributor pieces ("manifolds") can be provided with sound-damping. As a result, the sound transported via the medium can be effectively damped over a significant portion of the transport distance. Expediently, in one embodiment of the air conduction part, the shell and the damping device or dampener of the wall arrangement can be formed in one piece, and therefore the outlay when joining components of the wall arrangement can be omitted in the air conduction part according to the disclosure herein.

Accordingly, the disclosure herein makes it possible to manufacture, with a justifiable amount of outlay, air conduction parts comprising bent or curved regions as well as air conducting elements that have a changeable cross section and have sufficient and suitable sound-damping. Thus for example pipe bends in which the noise level is increased by the bend can be advantageously designed having a damping device or dampener and can also be integrated in places where sound-damping is desirable, for example directly in front of the air outlets of a passenger cabin.

In this case, sound-damping is to be understood to mean impeding sound propagation by absorbing airborne sound. During sound absorption, sound energy is converted into inaudible vibration energy waves, and reflection at a boundary surface is accordingly reduced. The physical mechanisms of sound-damping that occur in the process in the immediate vicinity of boundary surfaces are the viscous friction in the hydrodynamic boundary layer, and a loss-incurring thermal state change that takes place during the acoustic process in thermal boundary layer of the medium. The heat transfer from and to the wall means that the state change is not isentropic or adiabatic, whereas this certainly is the case further away from the wall. The mechanisms that occur are dependent on the size of the boundary surface that forms one of the surfaces. In this case, airborne sound is absorbed particularly efficiently when porous materials having open pores are used in the damping device or dampener, which materials have a large inner surface area.

In an embodiment of the air conduction part according to the disclosure herein in which the sound is damped particularly effectively, the wall arrangement can extend around the longitudinal axis of the air conduction part and form a closed face, with the result that the transported medium is completely surrounded by the wall arrangement. On account of environmental conditions such as space requirements or the space available, it is conceivable for the wall arrangement to define the transport path of the medium in an open manner.

In order to be able to damp the sound on the wall arrangement in a suitable manner, in a further embodiment of the air conduction part according to the disclosure herein the damping device or dampener can be provided with at least one sound absorption element. In principle, the purpose of the damping device or dampener comprising the at least one sound absorption element is that of reducing the airborne sound that propagates along the extension of one or more air conduction parts, without opposing the flowing medium with a significant resistance in the process. Despite integration with the shell(s) of the wall arrangement, it is conceivable to provide a plurality of identical or different sound absorption elements on the damping device or dampener. The damping device or dampener itself preferably forms a substantially complete lining for the air conduction part and also preferably has a streamlined shape with regard to the transport or flow direction of the medium.

In this case it is conceivable, as the cross section increases, for a number of air conduction parts that are arranged one behind the other in the flow direction and form a channel to be divided into narrower individual ducts of the channel in question, which ducts extend in the flow direction. This can be achieved, for example, by arranging further sound absorption elements that can form the channel division and then each form a type of dividing gate.

Since the sound damping is understood, in physical terms, as energy conversion, i.e. dissipation, the sound propagation can be impeded by using sound-dissipating media, for example in the form of sound-damping materials. Therefore, in an advantageous development of the air conduction part, the at least one sound absorption element can be formed having a sound-dissipating medium, in particular a porous absorption material. The vibrations of the air molecules caused by the sound are decelerated in the porous absorption material. The sound energy is thus ultimately converted to heat energy by frictional processes at boundary layers.

In some embodiments that further increases the effectiveness of the damping, the wall arrangement can comprise a plurality of shells, it being possible for the at least one damping device or dampener to be arranged between at least two of the plurality of shells. Particularly preferably, in this case, at least one of the plurality of shells of the wall arrangement can have a perforated structure. This perforated structure is advantageous in a side of the wall arrangement that faces the flow cross section, since increased damping can result from interactions of the sound with fluidic turbulence on the perforated structure. The perforated structure of the shell in question can be provided with a random or defined perforation.

In some embodiments a wall arrangement comprising a plurality of shells, between which at least one sound absorption element is arranged, can be provided on a development of the air conduction part according to the disclosure herein, which wall arrangement forms a Helmholtz resonator that can contribute significantly to reducing the acoustic power emitted. In principle, a wall arrangement can be formed as a resonator of this kind, in this case for example having a perforated shell as the inner shell, having a closed shell as the outer shell, and a sound absorption element having a type of honeycomb structure arranged therebetween. In a Helmholtz resonator, properties of a spring-mass oscillator are used in order to damp vibrations. The volume of the medium located in the honeycomb structure of the sound absorption element forms a spring opposing the air mass located at the end thereof in a hole of the perforated structure of the inner shell. If this mass is stimulated by incident sound waves so as to vibrate, this causes the stimulating sound energy to be converted to heat. This occurs, for example, on account of frictional mechanisms on the inner surfaces of the holes, compression and expansion of the air volume in the honeycombs of the honeycomb structure, and shedding of vortices at the hole edges. In principle, however, other embodiments of the air conduction part are also possible.

When the damping device or dampener and shells are suitably configured, damping of high and medium frequencies, as well as of low frequencies, can be achieved.

The transport of the medium can be promoted by a uniform, constant cross section along the longitudinal extension, and therefore, in a further embodiment of the air conduction part according to the disclosure herein, the cross section of the air conduction part comprising the at least one wall arrangement has a curvature, in particular a uniform curvature. In this case, the pipe portion together with the at least one wall arrangement can preferably form a channel having a round, in particular circular or elliptical, cross section. Cross sections of this kind are particularly streamlined because they form no or only minor obstacles for the flow of the medium and thus, simply on account of their shape, contribute to sound prevention and thus lower noise pollution overall when media are being transported.

In order to lay flow channels when subject to geometric restrictions, an advantageous development of the air conduction part according to the disclosure herein can consist in or comprise the air conduction part according to the disclosure herein having a substantially identical cross section at least for a portion of the longitudinal extension thereof and/or having a changing, in particular uniformly changing, cross section at least for a portion of the longitudinal extension thereof. This can be necessary for example when an obstacle protrudes into the original cross section of the air conduction part and the cross section initially constricts, for example when viewed in the flow direction, in order to then return to its original geometry after the obstacle has been passed. This constriction can occur at the wall arrangement of the air conduction part in a uniform manner in a plurality of spatial directions, at least in a constant manner in each of the spatial directions individually.

In some embodiments, it is advantageous in terms of flow technology for the cross section of the air conduction part according to the disclosure herein to have a geometric shape, in particular a shape that is point-symmetric with respect to the longitudinal axis thereof or mirror-symmetric with respect to a plane containing the longitudinal axis, such that the cross section is formed so as to be circular or elliptical in shape.

A method for producing an air conduction part for conducting a compressible medium, which air conduction part has a clear cross section through which the medium passes in a preferred movement direction when the air conduction part is used, which direction approximately corresponds to a longitudinal axis of the air conduction part. In this case, the air conduction part according to the disclosure herein comprises at least one wall arrangement by which the cross section of the air conduction part is laterally delimited and through which the medium is conducted, and the air conduction part being designed that the wall arrangement of the air conduction part is formed having at least one shell and at least one damping device or dampener that removes sound energy from the medium, and in that the shell and the damping device or dampener are integrally interconnected. In a manner substantially similar to the above, the object is achieved by integrating the damping device or dampener on the shell which, as part of the wall arrangement, laterally defines the air conduction part, such that the wall arrangement changes the direction or cross section of the air conduction part while the medium is being transported, and thus by producing the damping device or dampener and the shell as one piece and/or in one operation.

In this case, a variant of the method has been found to be particularly expedient in which the shell and the damping device or dampener of the wall arrangement are produced in a generative, additive manufacturing process, such that one component can be formed in one piece together with the other in a manner requiring little outlay.

In a particularly preferred variant of the method according to the disclosure herein, the wall arrangement can be manufactured in this case by a stereolithography process, in particular by 3D printing. In this case, the air conduction parts already described are constructed in layers as three-dimensional workpieces. These workpieces can be constructed in a computer-aided manner from one or more fluid or solid materials according to specified dimensions and shapes. In this case, plastics materials, synthetic resins, ceramics and metals are used as typical materials, and the manufacturing apparatuses in which the chemical and physical melting and/or curing processes occur are also referred to as 3D printers.

In this case, 3D printing has some fundamental advantages compared with competing production methods, which advantages have resulted in a noticeable spread of these methods even in batch production of parts. Thus, for example, the advantage of 3D printing compared with the injection moulding process is that the laborious production of moulds and changing moulds is omitted. The advantage of 3D printing compared with all material-removing methods such as cutting, turning and drilling is that the loss of material is omitted. Furthermore, the process is usually more favourable in terms of energy, because the material is constructed in the required size and mass only once. Selective laser sintering for polymers, ceramics and metals, selective laser melting and electron beam melting for metals, stereolithography and digital light processing for fluid synthetic resins, and PolyJet modelling and fused deposition modelling for plastics materials and optionally also for synthetic resins can be cited as important manufacturing methods in 3D printing. However, other methods are also conceivable and envisioned.

The above embodiments and developments can be combined together in any meaningful manner. Further possible embodiments, developments and implementations of the disclosure herein also include combinations not explicitly mentioned of features of the disclosure herein which are described above or in the following in relation to the embodiments. In particular, a person skilled in the art will also add individual aspects as improvements or supplements to the respective basic forms of the present disclosure.

BRIEF DESCRIPTION OF THE DRAWINGS

The disclosure herein is explained in greater detail in the following, on the basis of embodiments shown in the drawings. In this case, in schematic drawings.

In all the drawings, like or functionally like elements and devices have been provided with the same reference numerals unless otherwise specified.

DETAILED DESCRIPTION

Figure 1:
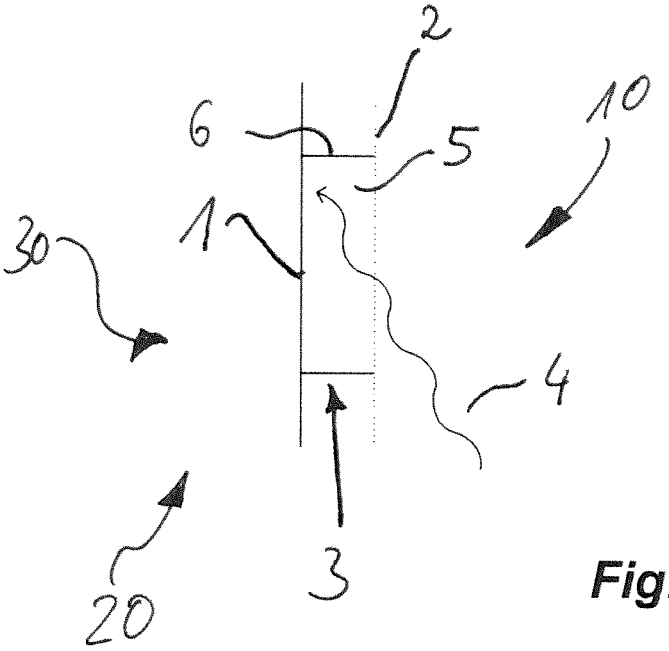
FIG. 1 is a sectional side view of a first embodiment of an air conduction part comprising one outer and one inner shell and damping device or dampener arranged therebetween.

FIGS. 1 to 4 each show an air conduction part that is denoted as a whole by 10 in each case and forms a part of a pipe portion 20 (not shown in its entirety) such that the longitudinal extension of the air conduction part 10 defines the flow direction of the medium in the pipe portion 20 in question, which pipe portion itself results from a rotation of the air conduction part 10 about a longitudinal axis (not shown) that extends in parallel with the flow direction. In this case, it can be seen in FIGS. 1 and 2 that the air conduction part 10 is formed having a sheet-like outer shell 1 that, in FIG. 1, and extends in the vertical direction from the perspective of the viewer. The outer shell 1 is formed integrally with a damping device or dampener 3 and a sound absorption element 5 made of porous material in that these parts are produced together in a generative manufacturing process. On the inner face thereof facing the inner face of the pipe portion 10, the damping device or dampener 3 comprises a perforated inner shell 2 that increases the sound-damping effect. The outer shell 1, the perforated inner shell 2 and the damping device or dampener 3 comprising the sound absorption element 5 form a wall arrangement 30 of the air conduction part 10, into which wall arrangement the sound 4 (indicated by an arrow) that is transported by the medium (not shown) flowing in the pipe portion 20 penetrates and is damped by the damping device or dampener.

Figure 2:
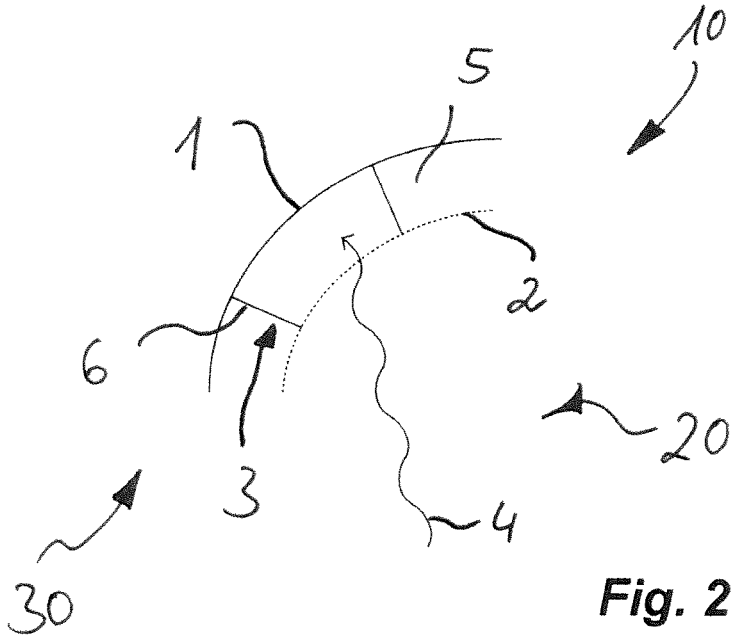
FIG. 2 is a sectional side view of a second embodiment of an air conduction part comprising one outer and one inner shell and damping device or dampener arranged therebetween, the air conduction part forming a bend.

FIG. 2 shows the substantive manner of FIG. 1 in a similar manner but having an air conduction part 10 that forms a bend and that, despite its curvature, is provided, on account of the generative manufacturing process used, with the same wall arrangement 30 having an integrated arrangement of curved shells 1, 2 as well as damping device or dampener 3. As in FIG. 1, support members 6 can be seen here too, which support members are arranged with regular spacing, protrude radially inwards from the outer shell 1 and promote the layered manufacture in the generative, i.e. additive, process because they stabilize the structure.

Figure 3:
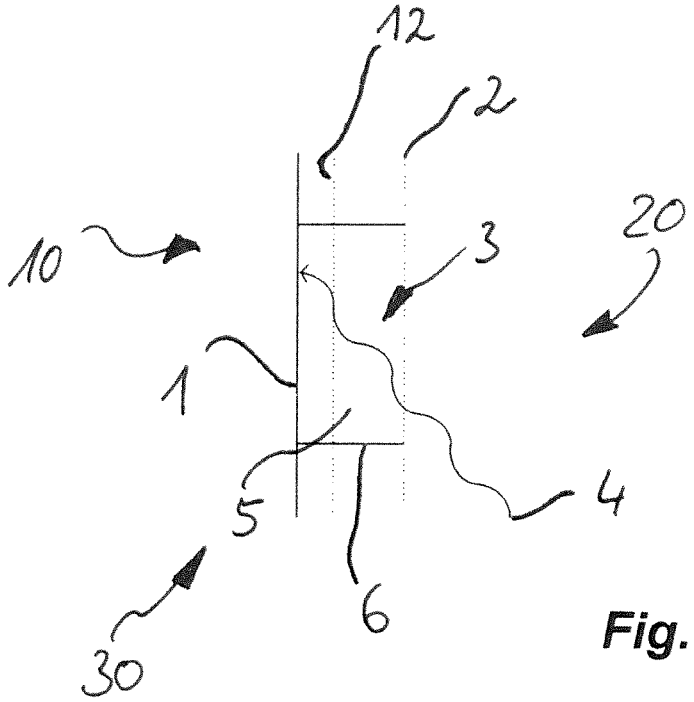
FIG. 3 is a sectional side view of a further embodiment of an air conduction part comprising one outer and a plurality of inner shells and damping device or dampener arranged between each of the shells.
Figure 4:
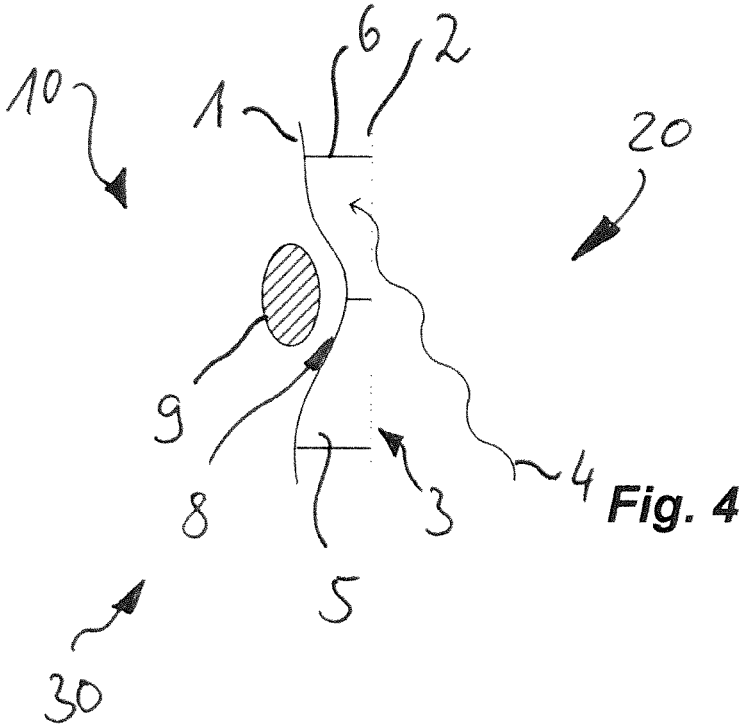
FIG. 4 is a sectional side view of a further embodiment of an air conduction part comprising a curved outer shell.

FIG. 3 shows an air conduction part 10 of a pipe portion 20 that is structurally similar to that of FIG. 1 but has improved sound-damping properties. This is due to the fact that, firstly, the sound absorption element 5 of the damping device or dampener 3 has a larger radial extent and, secondly, a further perforated inner shell 12 is arranged between the outer shell 1 and the perforated inner shell 2 so as to extend in parallel therewith, which further shell significantly increases the sound-damping effect.

FIG. 4 again shows an air conduction part 10 that is similar to that shown in FIG. 1. In this case, the air conduction part 10 is formed by a sheet-like outer shell 1 that, from the perspective of the viewer, extends in the vertical direction. The outer shell 1 is formed integrally with a damping device or dampener 3 and a sound absorption element 5 made of porous material in that these parts are produced together in a generative manufacturing process. In contrast with the air conduction part 10 of FIG. 1, in which the cross section of the air conduction part 10 is constant over the longitudinal extension thereof, the cross section of the air conduction part 10 in FIG. 4 changes in order to bypass a disruptive extraneous shape 9. For this purpose, the cross section of the air conduction part 10 has a constriction 8 that is achieved by an outer shell 1 that is curved multiple times. Since the sound absorption element 5 of the damping device or dampener 3 also adopts this curvature, the constriction 8 constitutes a material weakening at the relevant point of the height of the air conduction part 10 when the pipe portion 20 has a constant clear cross section. The generative manufacturing process means that even a complex geometry of this kind does not present any challenges when producing the air conduction part 10.

The disclosure herein described above accordingly relates to an air conduction part 10 for conducting a compressible medium, which part has a clear cross section through which the medium passes in a flow direction of the medium when the air conduction part 10 is used, which flow direction approximately corresponds to a longitudinal axis of the air conduction part 10, the air conduction part comprising at least one wall arrangement 30 that laterally defines the cross section of the air conduction part 10 and conducts the medium. In order to make available, with a justifiable amount of outlay, air conduction parts 10 having effective sound-damping and in which the transport direction of the medium and/or the cross section of the air conduction part 10 can change, the wall arrangement 30 is provided with at least one shell 1, 2 and with at least one damping device or dampener 3 that removes sound energy from the medium, and the shell 1, 2 and the damping device or dampener 3 are integrally interconnected.

Although the present disclosure has been disclosed in the above by way of preferred embodiments, it is not limited thereto, but can be modified in various ways. In particular, the disclosure herein can be varied or modified in a diverse manner without departing from the basic concept of the disclosure herein.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

What is claimed is:

1. An air conduction part for conducting a compressible medium therethrough, the air conduction part comprising:

At least one wall arrangement that laterally defines a cross section of the air conduction part, through which the medium passes in a flow direction of the compressible medium when the air conduction part is in use, the flow direction approximately corresponding to a longitudinal axis of the air conduction part, the wall arrangement comprising:

at least one shell; and at least one damping device configured to remove sound energy from the medium, wherein the shell and the at least one damping device are integrally interconnected by support members, and wherein the at least one damping device comprises at least one sound absorption element having at least one sound-dissipating medium, wherein the wall arrangement is disposed at least in a region of the air conduction part comprising a bend in the flow direction, and the support member extends radially inwards toward a center of the bend.

2. The air conduction part of claim 1, wherein the at least one shell and the at least one damping device of the at least one wall arrangement are formed in one piece.

3. The air conduction part of claim 1, wherein the at least one wall arrangement extends around the longitudinal axis of the air conduction part and forms a closed face.

4. The air conduction part of claim 1, wherein the at least one shell is an outer shell, the air conduction part comprising at least two perforated inner shells, the at least one damping device being arranged radially between the perforated inner shells.

5. The air conduction part of claim 1, wherein the at least one shell is an outer shell, which is formed such that the at least one wall arrangement comprises a variable cross section to bypass a disruptive extraneous shape, the air conduction part comprising at least one perforated inner shell.

6. The air conduction part of claim 5, wherein the at least one damping device is arranged radially between the outer shell and the inner shell so that the at least one damping device has a variable thickness.

7. The air conduction part of claim 1, wherein the at least one wall arrangement comprises a plurality of shells, and wherein the at least one damping device is arranged between at least two shells of the plurality of shells.

8. The air conduction part of claim 1, wherein at least one shell of the plurality of shells of the at least one wall arrangement has a perforated structure.

9. The air conduction part of claim 1, further comprising a further wall arrangement on the air conduction part including a plurality of shells, between which at least one sound absorption element is arranged, the plurality of shells and the at least one sound absorption element together forming a Helmholtz resonator.

10. The air conduction part of claim 1, wherein the cross section of the air conduction part comprising the at least one wall arrangement has a uniform curvature.

11. The air conduction part of claim 1, wherein the air conduction part comprising the at least one wall arrangement forms a pipe portion having a round cross section.

12. The air conduction part of claim 1, wherein an outer shell of the wall arrangement has curved shape while an inner shell has a constant shape, such that a wall thickness of the air conduction part has a uniformly changing cross section at least for a portion of the longitudinal extension thereof.

13. The air conduction part of claim 1, wherein the cross section of the air conduction part has a geometric shape.

14. The air conduction part of claim 1, wherein the at least one sound-dissipating medium includes a porous absorption material.

15. The air conduction part of claim 11, wherein the air conduction part comprising the at least one wall arrangement forms a channel having a circular or elliptical cross section.

16. The air conduction part of claim 12, wherein the geometric shape of the cross section of the air conduction part is point-symmetric with respect to the longitudinal axis thereof or mirror-symmetric with respect to a plane containing the longitudinal axis.

17. A method for producing an air conduction part for conducting a compressible medium therethrough, the method comprising:

providing at least one wall arrangement that laterally defines a cross section of the air conduction part, through which the medium passes in a flow direction of the compressible medium when the air conduction part is in use, the flow direction approximately corresponding to a longitudinal axis of the air conduction part and the wall arrangement of the air conduction part comprises at least one shell and at least one damping device that removes sound energy from the medium, wherein the at least one shell member and the at least one damping device are integrally interconnected by support members, wherein the at least one damping device comprises at least one sound absorption element having at least one sound-dissipating medium, and wherein the wall arrangement is disposed at least in a region of the air conduction part comprising a bend in the flow direction, and the support members extend radially inwards toward a center of the bend.

18. The method of claim 17, wherein the at least one shell and the at least one damping device of the wall arrangement are produced in a generative manufacturing process.

19. The method of claim 18, wherein the wall arrangement is manufactured by a stereolithography process.

20. The method of claim 17, wherein the at least one sound-dissipating medium includes a porous absorption material.

* * * * *